US006446586B2

(12) United States Patent
Fukamachi

(10) Patent No.: US 6,446,586 B2
(45) Date of Patent: Sep. 10, 2002

(54) ENGINE COOLING SYSTEM

(75) Inventor: Masatoshi Fukamachi, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/813,971

(22) Filed: Mar. 22, 2001

(30) Foreign Application Priority Data

Mar. 22, 2000 (JP) ..... 2000-084728

(51) Int. Cl.[7] ..... F01P 7/14
(52) U.S. Cl. ..... 123/41.1
(58) Field of Search ..... 123/41.1, 41.09, 123/41.08

(56) References Cited

FOREIGN PATENT DOCUMENTS

JP 54-120337 * 9/1979
JP 11082019 3/1999

* cited by examiner

*Primary Examiner*—Noah P. Kamen
(74) *Attorney, Agent, or Firm*—Birch, Stewart, Kolasch & Birch, LLP

(57) ABSTRACT

To improve the performance of a cooling system for an engine which includes a cylinder bore and a water jacket formed in an engine body, and in which a thermostat is attached to the engine body so that it projects from the engine body as little as possible, and is protected against hunting regardless of abrupt variations in cooling water temperature. A cylindrical thermostat includes a sliding space therein. Furthermore, the thermostat includes a housing having an inlet and an outlet facing each other. A wax case is slidably fitted in the sliding space in order to enable or disable communication between the inlet and the outlet in response to the expansion or contraction of the wax. An axis of the sliding space is parallel to an axis of a cylinder bore. The housing is directly attached to a body of the engine.

15 Claims, 8 Drawing Sheets

ENGINE COOLING SYSTEM

BACKGROUND OF THE INVENTION

1. Field of the Invention

The present invention relates to a cooling system for an engine. An engine body includes a cylinder bore, a water jacket, and a thermostat for controlling the flow of cooling water through the water jacket and a radiator in accordance with the temperature of the cooling water.

2. Background of the Invention

The above type of cooling system has been known from Japanese Patent Laid-Open No. Hei 11-82019. In the foregoing related art, the housing of the thermostat is supported between the cylinder head and the intake manifold. Furthermore, a wax case is supported by the housing in order to be slidable in a direction substantially orthogonal to the axis of the cylinder bore.

The thermostat projects extensively sideward from the engine body, which tends to reduce the layout tolerance of the cooling system. Furthermore, wax in contact with the cooling water expands or contracts depending upon temperature variations of the cooling water. As a result, the thermostat is subject to hunting if the cooling water temperature varies abruptly during warming-up of the engine. This can adversely affect the cooling performance for the engine body.

SUMMARY OF THE INVENTION

The invention has been made in order to overcome the foregoing problems of the background art, and provides an engine cooling system in which a thermostat projects from an engine body to a reduced extent and is protected against hunting in spite of abrupt variations in the cooling water temperature.

In accordance with a first feature of the present invention, there is provided a cooling system for an engine comprising an engine body having a cylinder bore and a water jacket, and a thermostat for controlling the passage of cooling water between the water jacket and a radiator in accordance with the temperature of the cooling water. In the cooling system, the thermostat includes a cylindrical housing with a sliding space and an inlet and an outlet which open onto an inner surface of the sliding space and face each other. Furthermore, a wax case which houses wax therein is slidable between positions for enabling and disabling communication between the inlet and the outlet in response to expansion or contraction of the wax. The wax case is slidably fitted in the sliding space. The housing, in which an axis of the sliding space is parallel to an axis of the cylinder bore, is directly attached to the engine body.

With the foregoing configuration, the thermostat is attached to the engine body such that the wax case slides in a direction parallel to the axis of the cylinder bore. This is effective in reducing a projecting amount of the thermostat from the engine body, and improving layout tolerance of the cooling system by assembling the thermostat in the engine body in a compact state. Furthermore, heat is transferred from the engine body to the wax, which is housed in the wax case, via the wax case and the housing. Therefore, even when cooling water temperature changes abruptly, a temperature of the wax exactly corresponds to a temperature of the engine body. This protects the thermostat against hunting, and improves the cooling performance. Furthermore, the path for circulating the cooling water in the thermostat can be simplified, and a resistance in the path can be reduced.

According to a second feature of the present invention, the housing is sandwiched between a cylinder block and a cylinder head that constitute a part of the engine body and are coupled with each other. No additional component is required in order to attach the thermostat to the engine body. In other words, the thermostat can be attached to the engine body using a reduced number of components.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

The invention will be described with reference to embodiments shown in the accompanying drawings.

Figure 1:
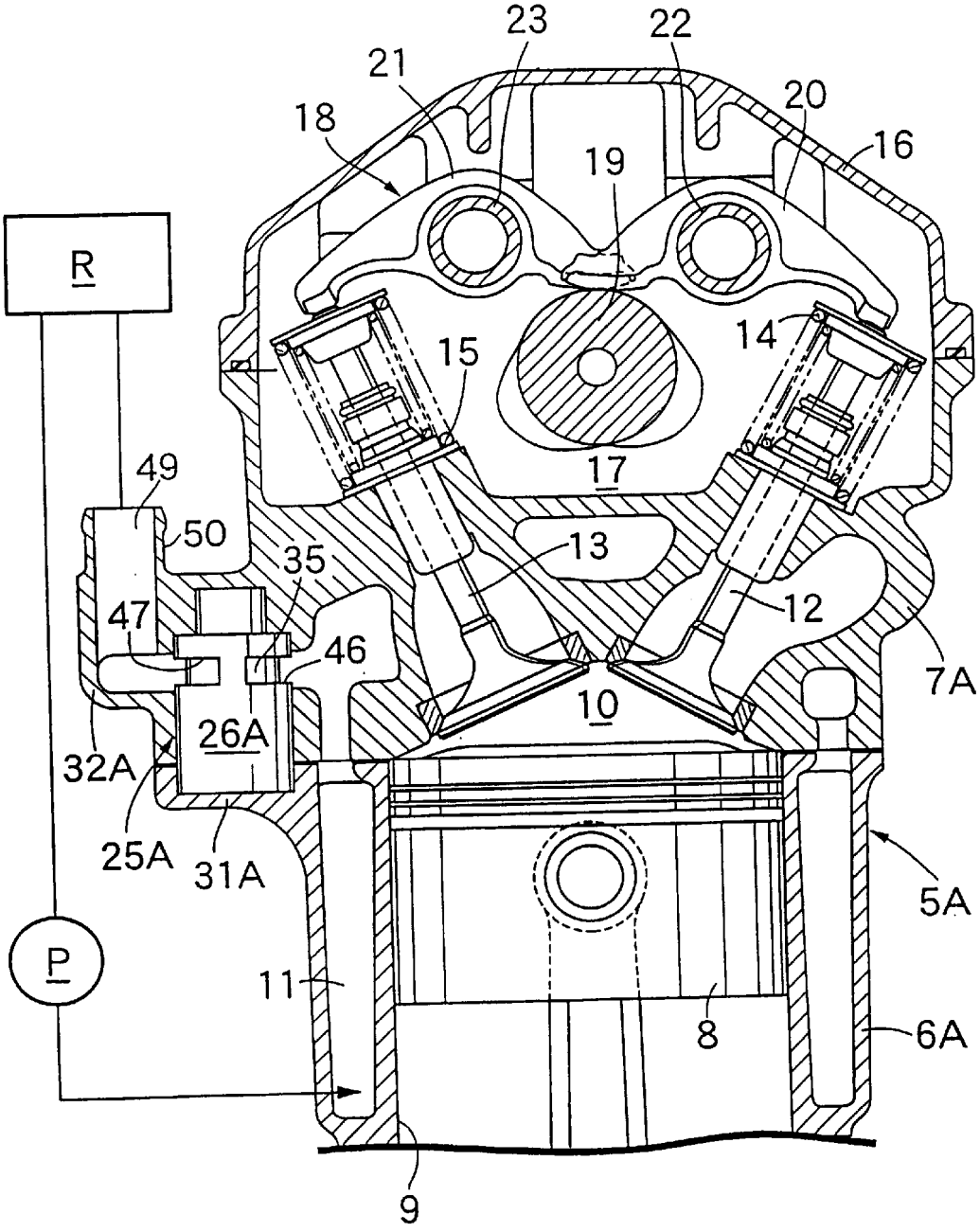
FIG. 1 is a longitudinal section of an engine, showing a part thereof.
Figure 2:
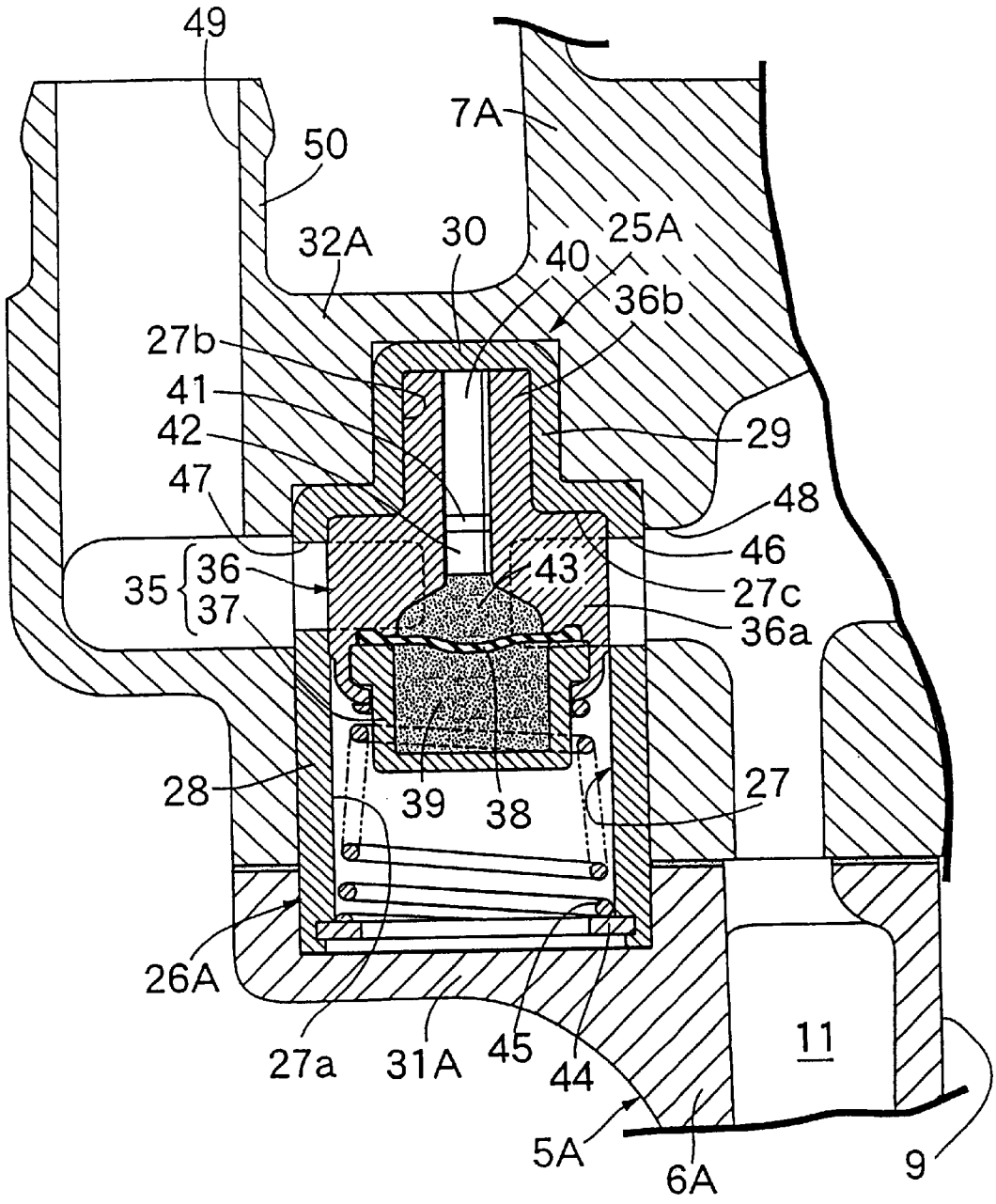
FIG. 2 is an enlarged view of the engine when it is cold.
Figure 3:
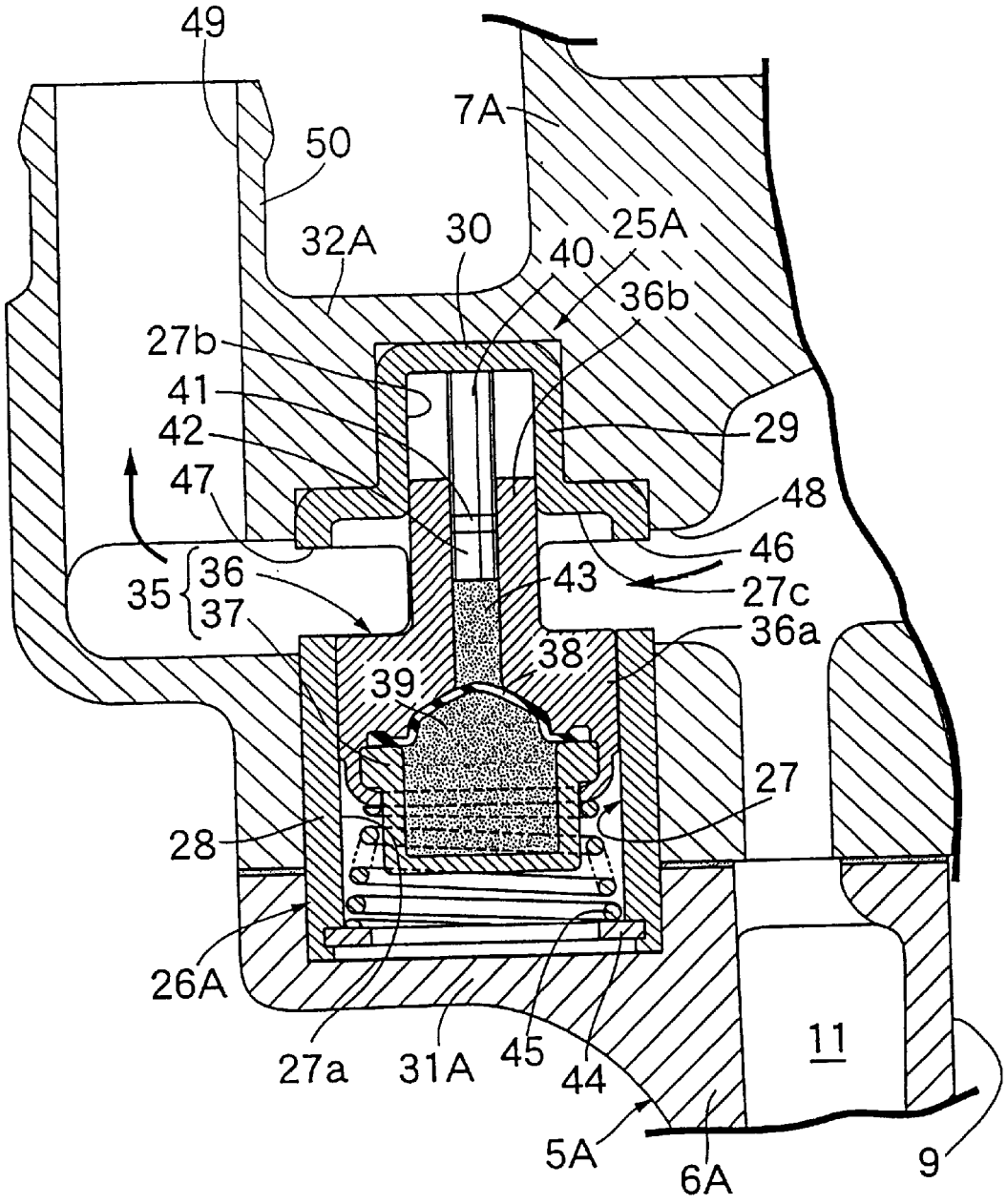
FIG. 3 is a view similar to FIG. 2 when the engine has been warmed up.

FIGS. 1 to 3 relate to a first embodiment of the present invention: FIG. 1 is a longitudinal section showing a part of an engine; FIG. 2 is an enlarged view of the engine while it is cold; and FIG. 3 is a view similar to FIG. 2 in which the engine has been warmed up.

Referring to FIG. 1, an engine body 5A of a water-cooled engine is mounted on a motorcycle, for example, and comprises a cylinder block 6A having a cylinder bore 9 in which a piston 8 is slidably fitted. A cylinder head 7A defines a combustion chamber 10 together with a top of the piston 8. A water jacket 11 is provided in the cylinder block 6A and the cylinder head 7A.

An inlet valve 12 for controlling the introduction of an air-fuel mixture to the combustion chamber 10 and an exhaust valve 13 for controlling the discharge of exhaust gases from the combustion chamber 10 are provided in the cylinder head 7A. The inlet valve 12 and exhaust valve 13 are opened and closed, and are urged to remain closed by valve springs 14 and 15, respectively.

A head cover 16 is coupled to the cylinder head 7A, and defines a valve chamber 17 together with the cylinder head 7A. The valve chamber 17 houses a valve system 18 for activating the inlet valve 12 and the exhaust valve 13. The valve system 18 includes a camshaft 19 coupled to a crankshaft (not shown) and operating in synchronization therewith. A rocker arm 20 is provided between the camshaft 19 and the inlet valve 12. A rocker arm 21 is provided between the camshaft 19 and the exhaust valve 13. The rocker arms 20 and 21 are swingably supported by stationary rocker shafts 22 and 23 having axes parallel to the camshaft 19.

The engine body 5A is provided with a thermostat 25A which enables or disables the passage of cooling water between the water jacket 11 and a radiator R. When the cooling water in the water jacket 11 has a low temperature while the engine remains cold, the thermostat 25A blocks the waterjacket 11 and the radiator R. Conversely, when the cooling water becomes hot after warm-up of the engine, the thermostat 25A enables communication between the water jacket 11 and the radiator R.

Referring to FIGS. 2 and 3, a cylindrical housing 26A of the thermostat 25A has a bottom, an open end, a stepped portion with a sliding space 27, a large diameter cylinder 28 having an open end, and a small diameter cylinder 29 which is thinner than the large diameter cylinder 28. The small diameter cylinder 29 has one end thereof coaxially coupled to the closed end of the large diameter cylinder 28. The other end of the small diameter cylinder 29 is closed by an end wall 30. The sliding space 27 is defined by a large diameter portion 27*a* of the large diameter cylinder 28, and a small diameter portion 27*b* of the small diameter cylinder 28. The large and small diameter portions 27*a* and 27*b* are coaxial with each other via an annular step 27*c*.

The housing 26A is sandwiched between the cylinder block 6A and the cylinder head 7A of the engine body 5A such that the axis of the sliding space 27 is parallel to the axis of the cylinder bore 9 in the engine body 5A.

The cylinder block 6A and cylinder head 7A are provided, as an integral part, with overhangs 31A and 32A in order to sandwich the thermostat 25A therebetween. The overhangs 31A and 32A slightly project sideward from the engine body 5A. The housing 26A has one end of the large diameter cylinder 28 fitted in the overhang 31A of the cylinder block 6A. The remaining part of the large diameter cylinder 28 and the small diameter cylinder 29 are fitted in the overhang 32A of the cylinder head 7A. As a result, the housing 26A is in direct contact with the engine body 5A.

A wax case 35 is slidably fitted in the sliding space 27 of the housing 26A. The wax case 35 includes a case body 36 whose outer surface is in direct contact with the sliding space 27, and a cover 37 coupled to the case body 36. A diaphragm 38 has its peripheral edge supported by the case body 36 and the cover 37. The case body 36 has a large diameter portion 36*a* slidably fitted in the large diameter portion 27*a* of the sliding space 27. A small diameter portion 36*b* is slidably fitted in the small diameter portion 27*b* of the sliding space 27. The small diameter portion 36*a* is cylindrical, and is coaxial with the large diameter portion 36*b*.

Wax 39 is housed in the wax case 35. The wax fills a space defined by the diaphragm 38 and the cover 37. The diaphragm 38 deforms itself in response to the expansion or contraction of the wax 39 in accordance with temperature variations. Furthermore, a rod-shaped piston 40, a disc 41 and a rubber piston 42 are sequentially and slidably fitted into the small diameter cylinder 29 of the housing 26A, via a side opposite to the diaphragm 38. A medium 43 is filled in the wax case 35 between the rubber piston 42 and the diaphragm 38, thereby transmitting the deformation of the diaphragm 38 to the rubber piston 42.

A stop ring 44 is attached on an inner surface of one end of the large diameter cylinder 28 of the housing 26A. A spring 45 is fitted into the stop ring 44 in order to urge the wax case 35 toward the annular step 27*c*. The wax case 35 is in contact with the annular step 27*c* as shown in FIG. 2 when the cooling water is cold and the wax 39 remains contracted. Conversely, when the cooling water becomes hot and the wax 39 expands, the diaphragm 38 flexes upward (as shown in FIG. 3). Since the piston 40 comes into contact with the end wall 30 and is pushed out of the small diameter portion 36*b*, the wax case 35 slides to move out of contact with the annular step 27*c* while contracting the spring 45, as shown in FIG. 3.

An inlet 46 and an outlet 47 are formed at the other end (near the annular step 27*c*) of the large diameter cylinder 28. The inlet 46 and the outlet 47 face each other on a line passing through the center of the large diameter cylinder 28. The communication between the inlet 46 and the outlet 47 is enabled or disabled in response to the sliding of the wax case 35 slidably fitted in the housing 26A. In other words, the wax case 35 slides between a position for disabling the communication between the inlet 46 and the outlet 47 when the engine remains cold as shown in FIG. 2, and a position for enabling the communication between the inlet 46 and the outlet 47 when the engine is warmed up, as shown in FIG. 3.

A path 48 for guiding the cooling water from the water jacket 11 to the thermostat 25A is formed in the cylinder head 7A. The housing 26A in which the path 48 communicates with the inlet 46 is sandwiched between the cylinder block 6A and the cylinder head 7A. A connecting pipe 50 projects from the overhang 32A of the cylinder head 7A as an integral part, forms a path 49 communicating with the outlet 47, and is connected to an inlet of the radiator R. An inlet and an outlet of a cooling water pump P are connected to an outlet of the radiator R and the water jacket 11, respectively.

The operation of the first embodiment will be described hereinafter. The housing 26A is attached to the engine body 5A with the axis of the sliding space 27 thereof being parallel to the axis of the cylinder bore 9. In other words, the thermostat 25A is attached to the engine body SA such that the wax case 35 in the housing 26A slides in the direction parallel to the axis of the cylinder bore 44. This structure is effective in making the thermostat 25A stick out of the engine body 5A as little as possible, enabling assembly of the thermostat 25A in the engine body 5A in a compact state, and improving the layout tolerance of the cooling system.

Furthermore, the housing 26A is attached to the engine body 5A such that it is in direct contact with the cylinder block 6A and the cylinder head 7A. The wax case 35 housing the wax 39 is in direct contact with the inner surface of the housing 26A and is slidable therein. Heat is transferred from the cylinder block 6A and cylinder head 7A to the wax 39 via the wax case 35 and housing 26A. Therefore, even if cooling water temperature abruptly changes due to warming up of the engine, the temperature of the wax 39 corresponds exactly to the temperatures of the cylinder block 6A and the cylinder head 7A. This is effective in protecting the thermostat 25A against hunting, and improving the cooling performance.

The housing 26A includes an inlet 46 communicating with the water jacket 11 and an outlet 47 communicating with the radiator R. The inlet 46 and the outlet 47 face each other on a line passing through a center of the housing 26A. The wax case 35 slides in the housing 26A so that communication is enabled or disabled between the inlet 46 and the outlet 47. Therefore, the cooling water passes through a straight path between the inlet 46 and outlet 47 in the thermostat 25A. This can simplify the path of the cooling water and reduce resistance therein. As a result, it is possible for the cooling water pump P to increase an amount of circulating cooling water, and contribute to reducing a driving force of the cooling water pump P, i.e., load applied to the engine.

Furthermore, the housing 26A is sandwiched between the cylinder block 6A and the cylinder head 7A which are coupled to constitute a part of the engine body 5A, so that no additional component is required in order to attach the thermostat 25A. This enables the thermostat 25A to be attached using a reduced number of components.

Figure 4:
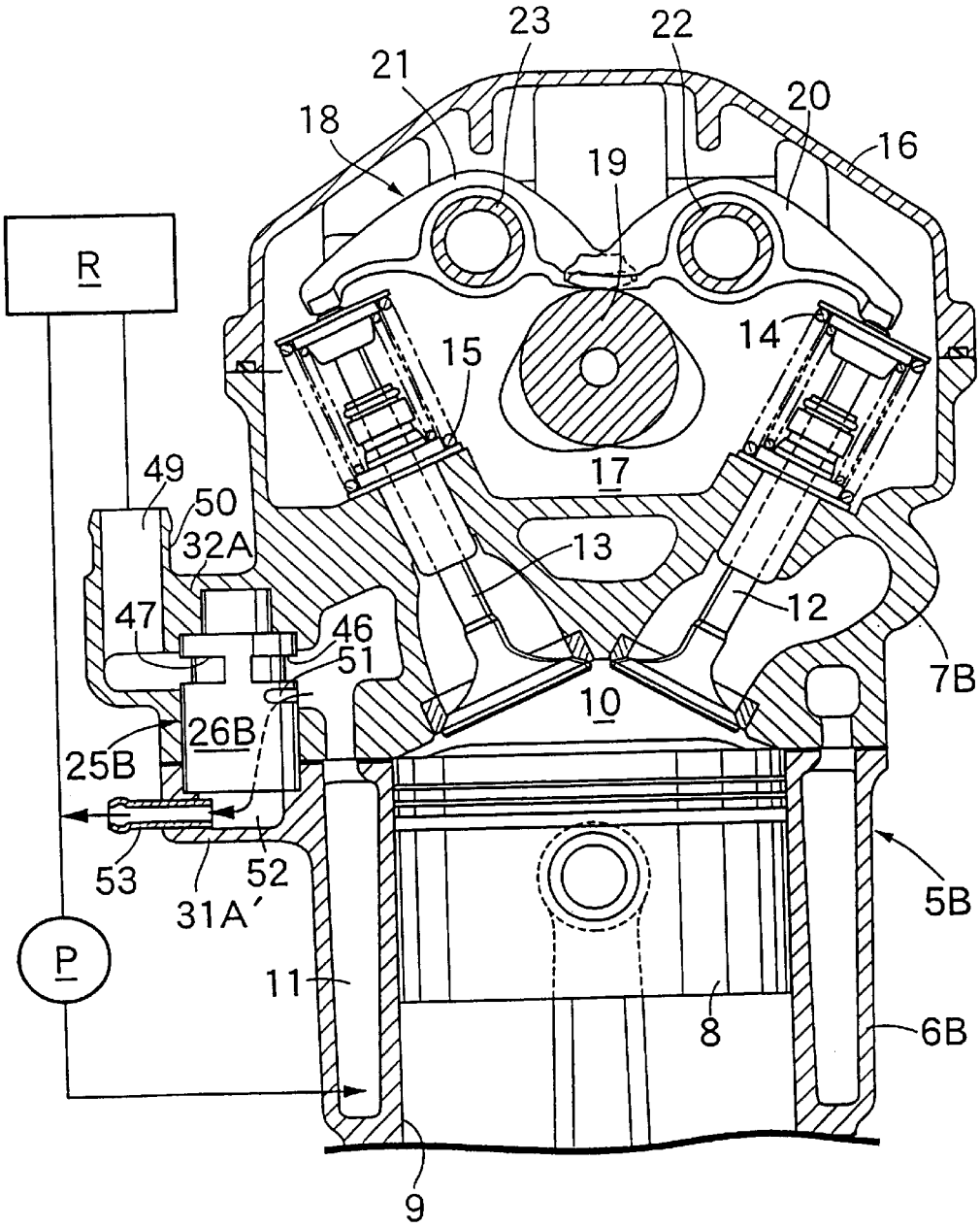
FIG. 4 is a longitudinal section of a part of an engine according to a second embodiment of the present invention;.
Figure 5:
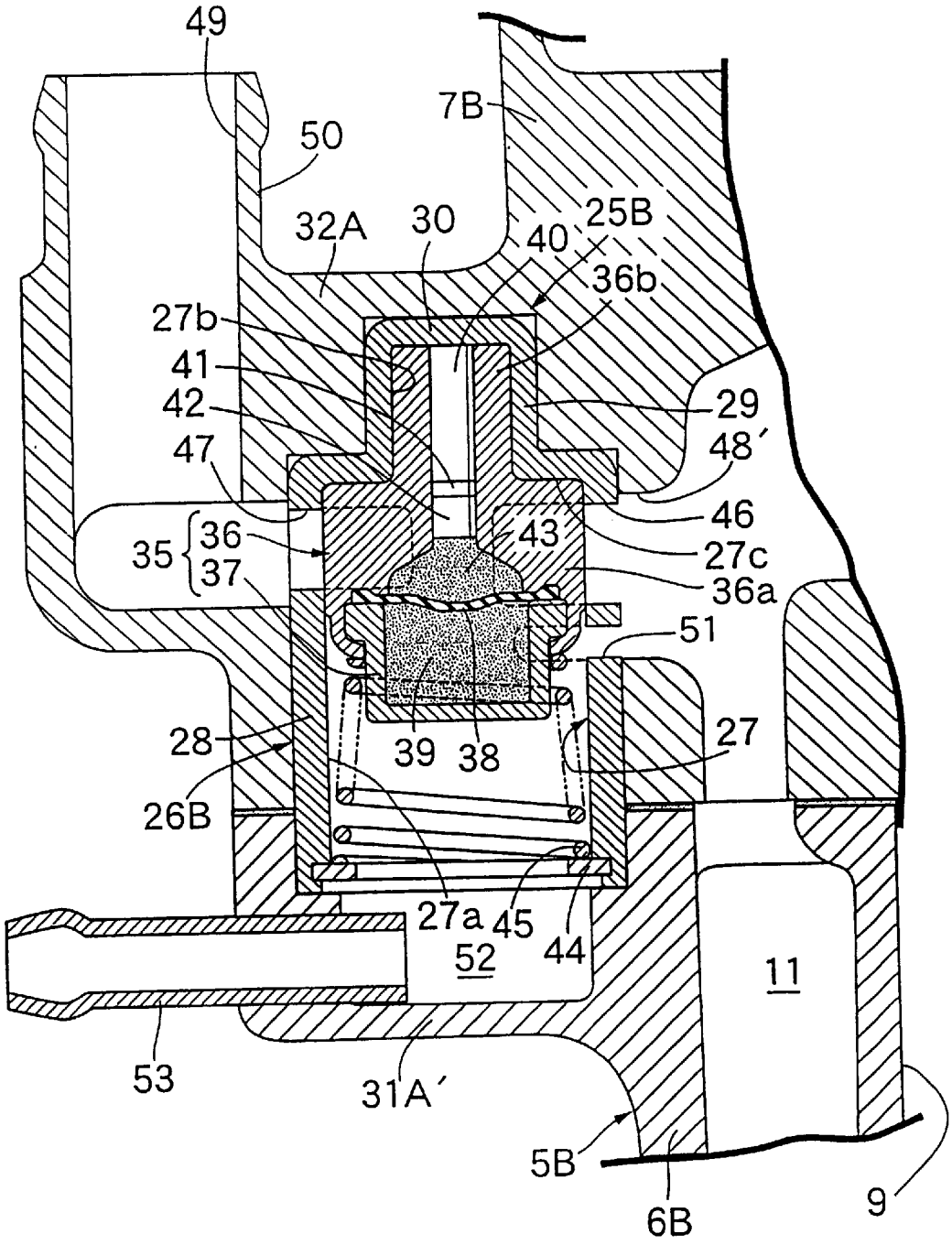
FIG. 5 is an enlarged view of the engine of the second embodiment when it is cold.
Figure 6:
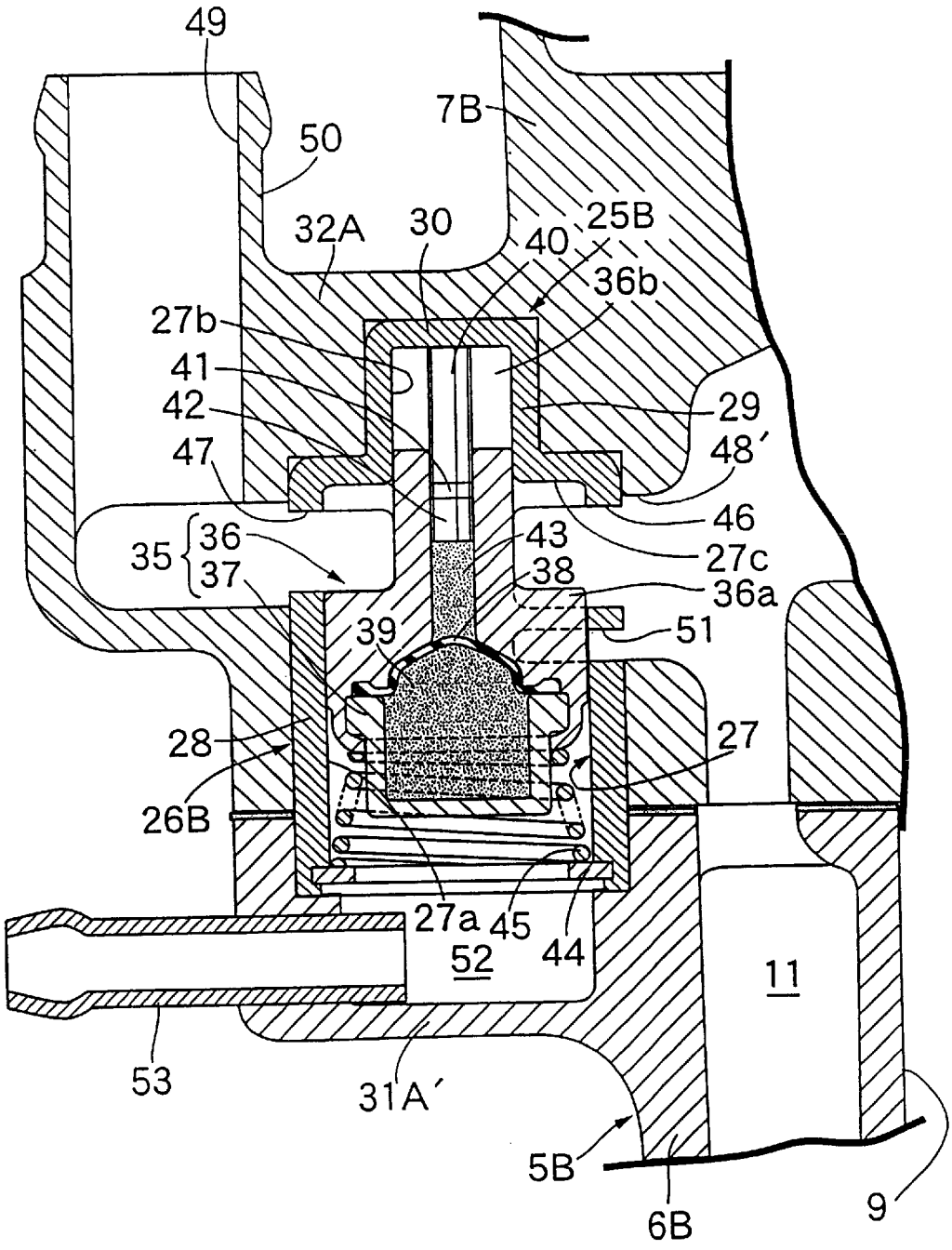
FIG. 6 is a view similar to FIG. 5 when the engine of the second embodiment of the present invention has been warmed up.

FIGS. 2 to 6 relate to a second embodiment of the present invention. FIG. 4 is a longitudinal section of a part of an engine. FIG. 5 is an enlarged view of FIG. 4 when the engine is cold. FIG. 6 is a view similar to FIG. 5 when the engine is warmed up.

A thermostat 25B is provided in an engine body 5B including a cylinder block 6B and a cylinder head 7B. The thermostat 25B enables or disables the passage of the cooling water between the water jacket 11 and radiator R.

A housing 26B of the thermostat 25B is substantially identical to the housing 26A of the first embodiment shown in FIGS. 1 to 3, but is provided with a bypass opening 51. In FIGS. 4 to 6, the reference numerals used for the housing 26A will be assigned to the parts similar to those in the first embodiment. No detailed description will be provided.

The housing 26B is sandwiched between an overhang 31A' of the cylinder block 6B and an overhang 32A of the cylinder head 7B in the engine body 5B such that the axis of the sliding space 27 is parallel to the axis of the cylinder bore 9, i.e. it is directly attached to the engine body 5B.

The wax case 35 is slidably fitted in the sliding space 27 of the housing 26B. The spring 45 is provided between the stop ring 44 attached to the inner surface of one end of the large diameter cylinder 28 of the housing 26B and the wax case 35 so that the wax case 35 is urged toward the annular step 27*c*.

The inlet 46 and the outlet 47 are formed in the large diameter cylinder 28 of the housing 26B. The inlet 46 and the outlet 47 face each other on the line passing through the center of the large diameter cylinder 28. The bypass opening 51 is positioned near the inlet 46, and is closed by the wax case 35 when it slides to a position (shown in FIG. 6) for enabling communication between the inlet 46 and the outlet 47.

A path 48' is formed in the cylinder head 7B in order to guide the cooling water from the water jacket 11 to the thermostat 25B. The path 48' communicates with the inlet 46 and the bypass opening 51 of the housing 26B which is sandwiched between the cylinder block 6B and the cylinder head 7B. The water chamber 52 is formed between the housing 26B, the wax case 35 and the overhang 31B. When the wax case 35 is at the position for blocking the inlet 46 and the outlet 47, the bypass opening 51 communicates with the water chamber 52. Furthermore, the connecting pipe 53 is provided at the overhang 31B, and is connected to the inlet of the cooling water pump P.

In the second embodiment, the wax case 35 is at the position for opening the bypass 51 and blocking the inlet 46 and the outlet 47 when the engine is cold. The cooling water from the water jacket 11 is sucked into the cooling water pump P via the bypass opening 51, water chamber 52 and connecting pipe 53, so that no heat is radiated from the cooling water by the radiator R. In this state, the engine can be quickly warmed up. Thereafter, the wax case 35 slides to the position for enabling communication between the inlet 46 and the outlet 47 and closing the bypass opening 51. Therefore, the cooling water is cooled by heat radiation of the radiator R.

The housing 26B is directly attached to the engine body 5B such that the axis of the sliding space 27 is parallel to the axis of the cylinder bore 9 in the engine body 5B. This embodiment is as advantageous as that of the first embodiment.

Figure 7:
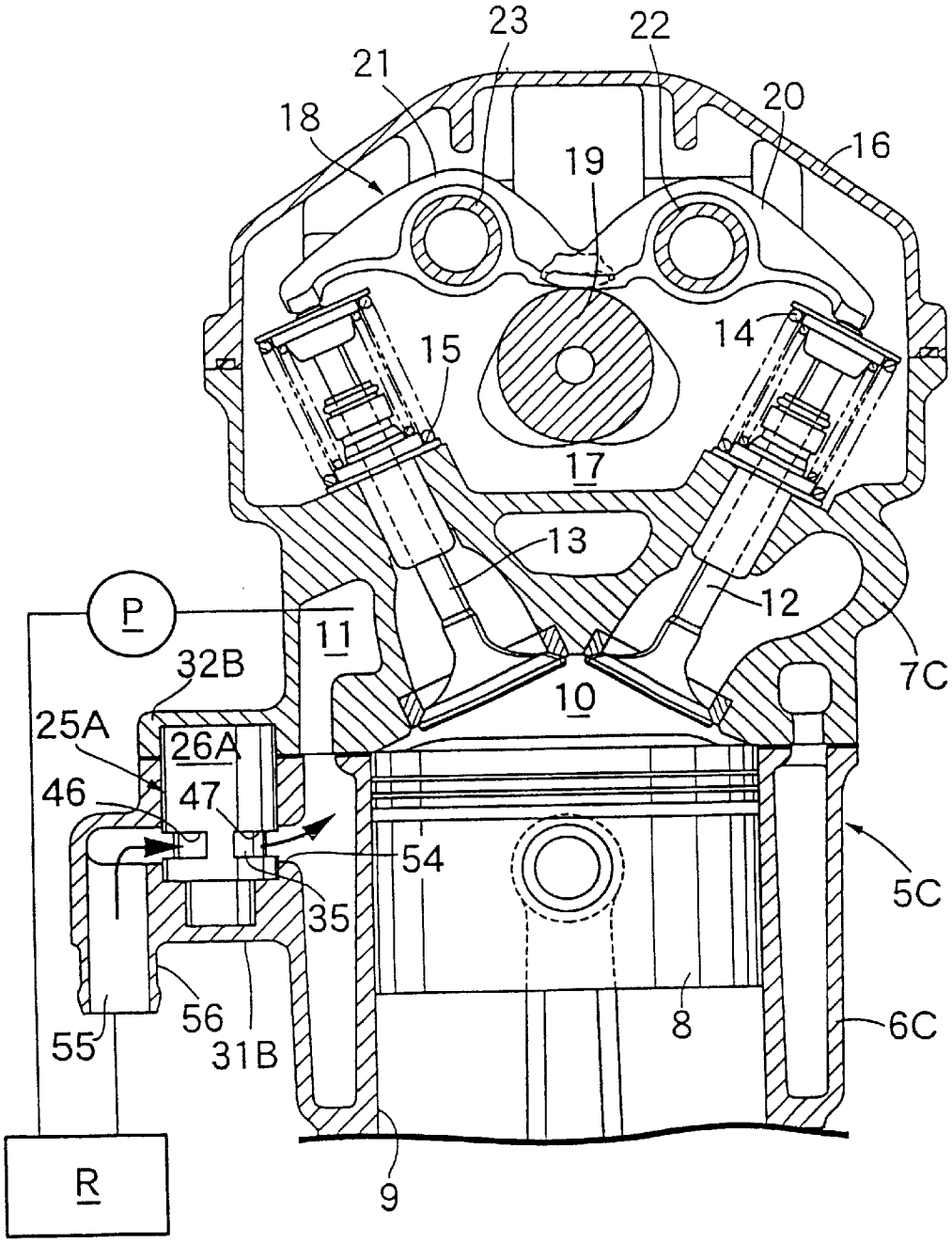
FIG. 7 is a longitudinal section of a part of an engine according to a third embodiment.

FIG. 7 shows a cooling system according to a third embodiment of the present invention. An engine body 5C includes not only a cylinder block 6C and a cylinder head 7C but also a thermostat 25A for enabling or disabling the passage of cooling water between the water jacket 11 and the radiator R.

A housing 26A of the thermostat 25A is sandwiched between an overhang 31B of the cylinder block 6C and an overhang 32B of the cylinder head 7C. The housing 26A is parallel to the axis of the cylinder bore 9, and is directly attached to the engine body 5C.

The cylinder block 6C has a path 54 for guiding the cooling water from the thermostat 25C to the water jacket 11. The housing 26A in which the outlet 47 communicates with the path 54 is sandwiched between the overhangs 31B and 32B of the cylinder block 6C and the cylinder head 7C. A connecting pipe 56 is provided as an integral part at the overhang 31B of the cylinder block 6C. Furthermore, the connecting pipe 56 communicates with the inlet 46 of the housing, and is connected to the outlet of the radiator R. The cooling water pump P has an outlet connected to the inlet of the radiator R, and an inlet connected to the water jacket 11.

Figure 8:
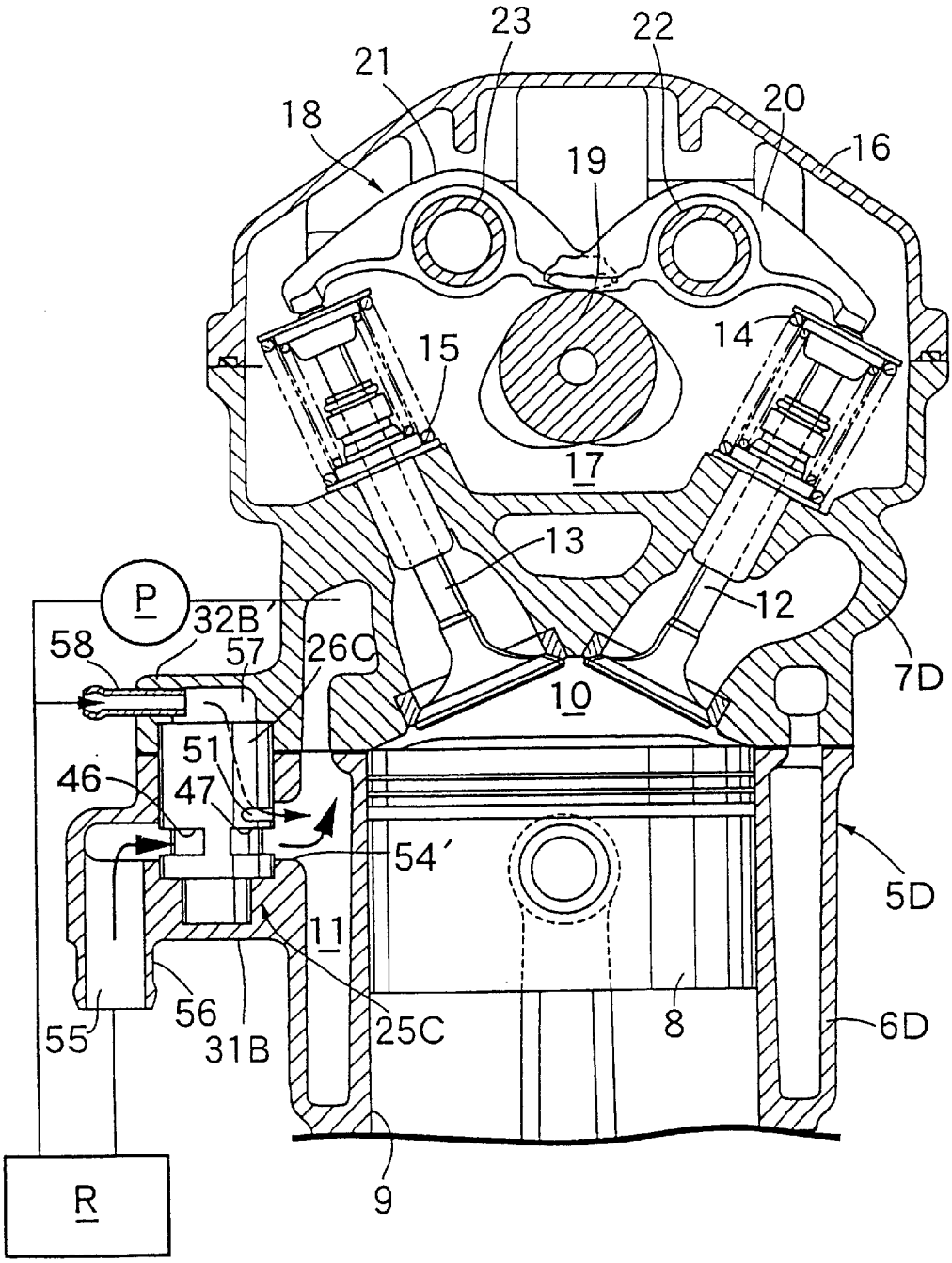
FIG. 8 is a longitudinal section of a part of an engine according to a fourth embodiment.

FIG. 8 shows a cooling system according to a fourth embodiment. An engine body 6D includes not only a cylinder block 6D and a cylinder head 7D but also a water jacket 11 and a thermostat 25C for enabling or disabling the passage of the cooling water between the water jacket 11 and a radiator R.

A housing 26C of the thermostat 25C is sandwiched between an overhang 31B of the cylinder block 6C and an overhang 32B' of the cylinder head 7D. Furthermore, the housing 26C is parallel to the axis of the cylinder bore 9, and is directly attached to the engine body 5D.

The housing 26C differs from the housing 26B of the second embodiment in that the bypass opening 51 is positioned near the outlet 47. In this embodiment, a path 54' is provided at the cylinder block 6D in order to guide the cooling water from the thermostat 25D to the water jacket 11. The housing 26C is sandwiched between the overhang 3 1B of the cylinder block 6D and the overhang 32B' of the cylinder head 7D in order that the outlet 47 and the bypass opening 51 communicate with the path 54'.

A water chamber 57 is formed between the overhang 32B' of the cylinder head 7D and the housing 26C. Furthermore, a connecting pipe 58 is attached to the overhang 32B'. The connecting pipe 58 communicates with the water chamber 57, and is connected to the outlet of the cooling water pump P and to the inlet of the radiator R.

The cooling systems of third and fourth embodiments are as advantageous as those of the first and second embodiments.

According to the first feature of the present invention, it is possible to make the thermostat stick out of the engine body as little as possible. It is also possible to assemble the thermostat in the engine body in a compact state, protect the thermostat against hunting, improve the cooling performance, simplify the cooling water circulating path, and reduce resistance therein.

In accordance with the second feature, the thermostat can be attached to the engine body without any additional components, i.e., using a reduced number of components.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A cooling system for an engine including an engine body having a cylinder bore and a water jacket, and a thermostat for controlling the passage of cooling water between the water jacket and a radiator in accordance with cooling water temperature, the improvement comprising:

said thermostat includes:

a cylindrical housing with a sliding space therein;

an inlet and an outlet opening onto an inner surface of the sliding space, said inlet and said outlet facing each other;

a wax case housed within said cylindrical housing, said wax case being slidably fitted in said sliding space and slidable between positions for enabling and disabling communication between said inlet and said outlet in response to expansion or contraction of the wax; and said housing is directly attached to the engine body with an axis of said sliding space parallel to an axis of a cylinder bore of the engine.

2. The engine cooling system of claim 1, wherein said housing is sandwiched between a cylinder block and a cylinder head, said cylinder block and cylinder head forming a part of the engine body and being coupled with each other.

3. The engine cooling system of claim 1, wherein said wax case further comprises a case body and a cover secured to said case body, said thermostat further comprising a diaphram secured by a perimeter thereof between said case body and said cover, and wherein said wax is located between said diaphram and said cover.

4. The engine cooling system of claim 3, said thermostat further comprising:

a spring biasing said wax case into a position for disabling communication between said inlet and said outlet;

at least one piston, said wax case being slidable with respect to said at least one piston; and a medium located between said at least one piston and said diaphram.

5. The engine cooling system of claim 1, wherein said cylindrical housing includes a bypass opening formed therein, said bypass opening being opened and closed by movement of said wax case to enable and disable flow of cooling water therethrough, said bypass opening being in an open condition when said wax case disables communication between said inlet and said outlet.

6. The engine cooling system of claim 1, wherein a cylinder block and a cylinder head of the engine body include overhangs formed integrally therewith, said cylindrical housing being sandwiched between said overhangs of the cylinder block and the cylinder head.

7. The engine cooling system of claim 6, wherein the overhang of the cylinder head includes a connecting pipe formed integrally therewith, said connecting pipe being in communication with said outlet of said thermostat.

8. The engine cooling system of claim 6, wherein the overhang of the cylinder block includes a connecting pipe formed integrally therewith, said connecting pipe being in communication with said inlet of said thermostat.

9. The engine cooling system of claim 1, wherein said cylindrical housing and said wax case each have a large diameter portion and a small diameter portion, said large diameter portion of said wax case fitting within said large diameter portion of said cylindrical housing, and said small diameter portion of said wax case fitting within said small diameter portion of said cylindrical housing.

10. A thermostat for a cooling system of an engine, the engine including an engine body having a cylinder bore and a water jacket, said thermostat for controlling the passage of cooling water between the water jacket and a radiator in accordance with cooling water temperature and comprising:

a cylindrical housing with a sliding space therein;

an inlet and an outlet opening onto an inner surface of the sliding space, said inlet and said outlet facing each other;

a wax case housed within said cylindrical housing, said wax case being slidably fitted in said sliding space and slidable between positions for enabling and disabling communication between said inlet and said outlet in response to expansion or contraction of the wax; and said housing is directly attachable to the engine body with an axis of said sliding space parallel to an axis of a cylinder bore of the engine.

11. The thermostat of claim 10, wherein said housing is securable to the engine by being sandwiched between a cylinder block and a cylinder head of the engine, the cylinder block and cylinder head forming a part of the engine body and being coupled with each other.

12. The thermostat of claim 10, wherein said wax case further comprises a case body and a cover secured to said case body, said thermostat further comprising a diaphram secured by a perimeter thereof between said case body and said cover, and wherein said wax is located between said diaphram and said cover.

13. The thermostat of claim 12, further comprising:

a spring biasing said wax case into a position for disabling communication between said inlet and said outlet;

at least one piston, said wax case being slidable with respect to said at least one piston; and a medium located between said at least one piston and said diaphram.

14. The thermostat of claim 10, wherein said cylindrical housing includes a bypass opening formed therein, said bypass opening being opened and closed by movement of said wax case to enable and disable flow of cooling water therethrough, said bypass opening being in an open condition when said wax case disables communication between said inlet and said outlet.

15. The thermostat of claim 10, wherein said cylindrical housing and said wax case each have a large diameter portion and a small diameter portion, said large diameter portion of said wax case fitting within said large diameter portion of said cylindrical housing, and said small diameter portion of said wax case fitting within said small diameter portion of said cylindrical housing.

* * * * *